US007576705B2

(12) United States Patent
Greenfield et al.

(10) Patent No.: US 7,576,705 B2
(45) Date of Patent: Aug. 18, 2009

(54) ANTENNA TOWER MOUNTING ASSEMBLY AND METHOD

(75) Inventors: Roger F Greenfield, Alto, MI (US); Randall L McIntyre, Alto, MI (US)

(73) Assignee: Tennagon, Inc., Freeport, MI (US)

( * ) Notice: Subject to any disclaimer, the term of this patent is extended or adjusted under 35 U.S.C. 154(b) by 266 days.

(21) Appl. No.: 11/267,639

(22) Filed: Nov. 4, 2005

(65) Prior Publication Data

US 2006/0092090 A1 May 4, 2006

Related U.S. Application Data

(60) Provisional application No. 60/625,421, filed on Nov. 4, 2004.

(51) Int. Cl.
*H01Q 1/12* (2006.01)

(52) U.S. Cl. ..... 343/890; 343/891; 343/892

(58) Field of Classification Search ..... 343/890, 343/891, 892, 878, 880, 881, 882
See application file for complete search history.

(56) References Cited

U.S. PATENT DOCUMENTS

| | | | | | |
|---|---|---|---|---|---|
| 2,510,059 | A * | 6/1950 | Black | 52/40 |
| 2,771,606 | A * | 11/1956 | Kandoian | 343/890 |
| 3,302,345 | A * | 2/1967 | Ballantine | 52/121 |
| 4,652,890 | A * | 3/1987 | Crean | 343/882 |
| 5,291,211 | A * | 3/1994 | Tropper | 343/890 |
| 5,533,304 | A * | 7/1996 | Noble | 52/40 |
| 5,649,402 | A * | 7/1997 | Moore | 52/651.02 |
| 5,787,673 | A * | 8/1998 | Noble | 52/726.1 |
| 5,855,103 | A * | 1/1999 | Moore | 52/651.02 |
| 6,026,627 | A * | 2/2000 | Moore | 52/651.02 |
| 6,088,002 | A * | 7/2000 | Johnson et al. | 343/878 |
| 6,232,928 | B1 * | 5/2001 | Zimmerman et al. | 343/882 |
| 6,897,828 | B2 * | 5/2005 | Boucher | 343/890 |
| 2004/0027307 | A1 * | 2/2004 | Hossein | 343/890 |
| 2004/0032375 | A1 * | 2/2004 | Ianello et al. | 343/890 |

* cited by examiner

*Primary Examiner*—HoangAnh T Le
(74) *Attorney, Agent, or Firm*—Harness, Dickey & Pierce, P.L.C.

(57) ABSTRACT

A device to couple an antenna array to a tower having three poles. The device includes a mast member and three support members. Each of the support members has a vertical portion and an angled portion. The angled portion is coupled to the mast member. The vertical member is operable to connect to one of the three poles and is generally aligned with the mast member.

20 Claims, 10 Drawing Sheets

ANTENNA TOWER MOUNTING ASSEMBLY AND METHOD

CROSS-REFERENCE TO A RELATED APPLICATION

This application claims the benefit of U.S. Provisional Application No. 60/625,421, filed on Nov. 4, 2004. The above disclosure is hereby incorporated by reference as fully set forth herein.

FIELD

The present teachings relate to antenna towers and more particularly relate to a device and method to couple an antenna array to a tower.

BACKGROUND

Traditionally, an antenna tower is constructed with three poles and lattice-work between the three poles to provide structural support. An antenna array is typically mounted to only one of the three poles of the antenna tower with a bracket. The bracket can include various fasteners such as thumb-wheel locks or clamps to facilitate clamping the bracket to the pole. The various brackets, fasteners and clamps, however, have little uniformity among the pieces and as such numerous configurations may be required to facilitate installation on many different antenna towers, especially for a large-scale installation project.

SUMMARY

The present teachings generally include a device to couple an antenna array to a tower having three poles. The device includes a mast member and three support members. Each of the support members has a vertical portion and an angled portion. The angled portion is coupled to the mast member. The vertical member is operable to connect to one of the three poles and is generally aligned with the mast member.

In other examples, the present teachings generally include an antenna mounting device to connect an antenna array to an antenna tower. The antenna mounting device includes a first collar portion and a second collar portion. A spoke assembly extends from the first collar portion. A mounting assembly couples to the spoke assembly. The mounting assembly holds at least a portion of the antenna array. The first collar portion and the second collar portion are joinable to couple to at least a portion of the antenna tower.

Further areas of applicability of the present teachings will become apparent from the detailed description and appended claims provided hereinafter. It should be understood that the detailed description and specific examples, while indicating the various embodiments of the present teachings are intended for purposes of illustration only and are not intended to limit the scope of the teachings.

BRIEF DESCRIPTION OF THE DRAWINGS

The present teachings will become more fully understood from the detailed description, the appended claims and the accompanying drawings, wherein:

DETAILED DESCRIPTION OF THE VARIOUS EMBODIMENTS

The following description of the various embodiments of the present teachings is merely exemplary in nature and is in no way intended to limit the teachings, their application or uses.

Figure 1:
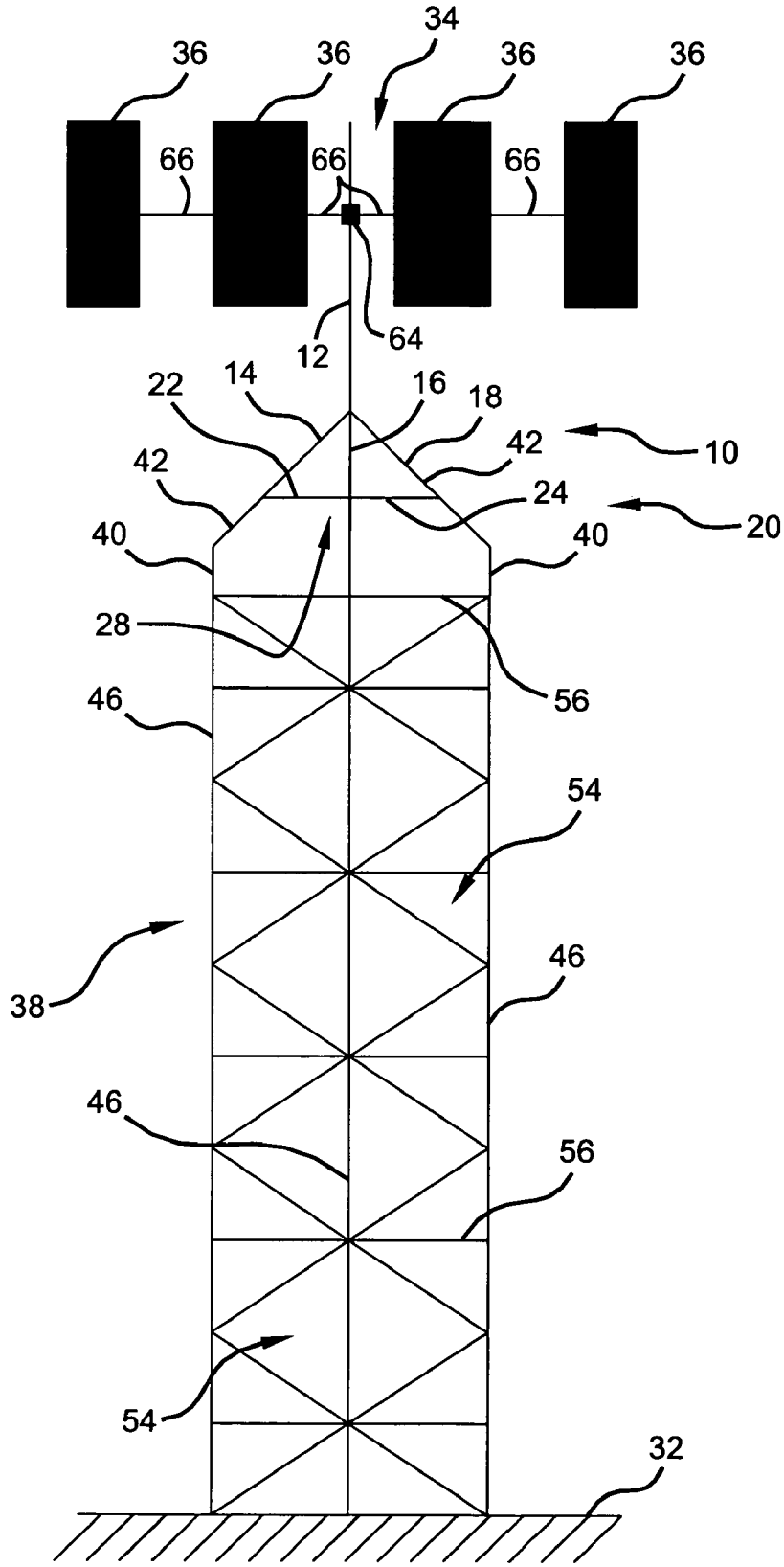
FIG. 1 is a schematic view of an exemplary tower and an exemplary antenna array connected to the tower with a tower assembly and an antenna mounting assembly in accordance with the present teachings.
Figure 2:
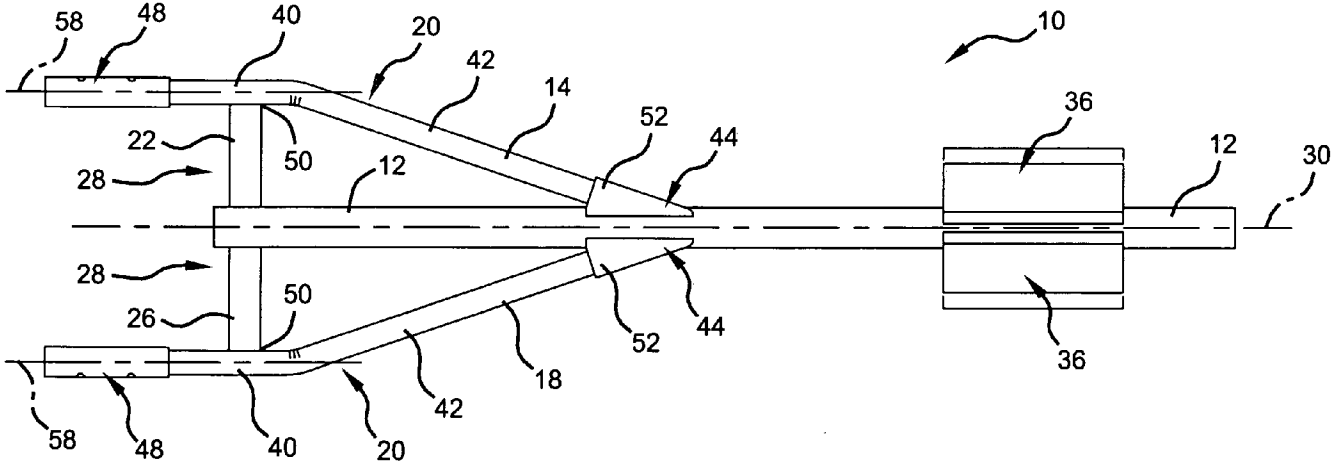
FIG. 2 is a side view of a tower assembly in accordance with the present teachings showing a mast member and two of three support members.

With reference to FIGS. 1 and 2, a tower assembly 10 is shown in accordance with the present teachings. The tower assembly 10 includes a mast member 12, a first support member 14, a second support member 16 (FIG. 1) and a third support member 18, which are collectively referred to as support members 20. The tower assembly 10 also includes a first brace member 22, a second brace member 24 (FIG. 1) and a third brace member 26 (FIG. 2), which are collectively referred to as brace members 28. The mast member 12 is a generally straight member having a longitudinal axis 30 (FIG. 2) that can be generally normal to the ground 32 (FIG. 1). The tower assembly 10 can couple an antenna mounting assembly 34 (FIG. 4A), 34*a* (FIG. 5A), 34*b* (FIG. 6A), an antenna array 36 or other suitable structures to an exemplary antenna tower 38. The cross-sectional shape of the various components of the tower assembly and the antenna mounting assembly 34, 34*a*, 34*b* can be circular, rectangular or any suitable polygonal shape.

Figure 3:
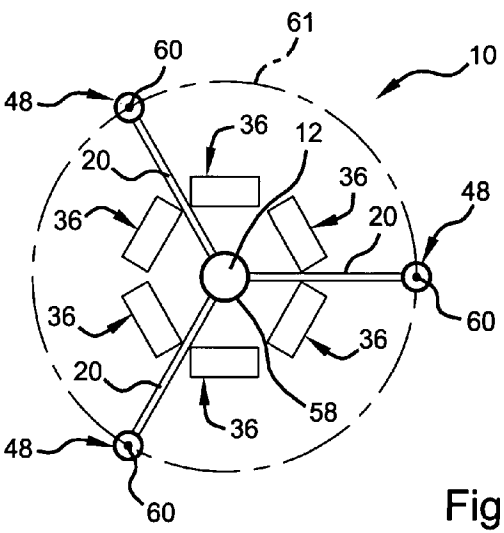
FIG. 3 is a top view of the tower assembly of FIG. 2 showing the exemplary antenna array mounted thereto.

Each of the support members 20 can have a vertical portion 40 and an angled portion 42. Each of the angled portions 42 can connect to the mast member 12 at respective support connections 44. Each of the vertical portions 40 can connect to a pole 46 (e.g., three poles 46) of the antenna tower 38. With reference to FIGS. 2 and 3, the vertical portion 40 of each of the support members 20 can include a coupling portion 48 that is distal from the respective angled portions 42. The coupling portions 48 can be configured to connect each of the poles 46 of the antenna tower 38 to the tower assembly 10. In one example, the coupling portions 48 are an oversized tube (i.e., relative to the outer diameter of the poles 46) that fit over each of the poles 46 of the antenna tower 38. The coupling portions 48 can be fastened to the poles 46 with various suitable fasteners or bonding mechanisms including mechanical fastening, chemical bonding, welding and/or combinations thereof.

Each of the brace members 28 can connect each of the respective vertical portions 40 of the support members 20 to the mast member 12. In one example, the brace members 28 are oriented at an angle that is about orthogonal to the mast member 12. Each of the brace members 28 connect to the respective vertical portions 40 of the support members 20 at a brace connection point 50. The brace connection point 50 is distal from the coupling portion 48 and adjacent to the angled portions 42 of the respective support members 20. It can be appreciated that the brace members 28 can connect to the mast member 12 and/or the support members 20 at various suitable orientations and with various forms of connection including mechanical fastening, chemical bonding, welding and/or combinations thereof.

Each of the support members 20 can connect to the mast member 12 at the respective support connections 44. Each of the support connections 44 can also include a cover 52 that can, for example, shield the support connections 44. Each of the support connections 44 can be radially spaced about the mast member 12 at about 120 degrees from each other. It can be appreciated that the support members 20 can be spaced at various radial orientations relative to each other about the mast member 12. It can be further appreciated that the radial spacing of the support members 20 about the mast member 12 can be specific to a model of the antenna tower 38, such that certain models can have different orientations of the poles 46.

With reference to FIG. 1, it can be appreciated that the tower assembly 10 can connect to various antenna towers 38, which can be constructed in a manner known in the art. Briefly, the antenna towers 38 can be constructed with a three-pole arrangement. The three poles 46 can be interconnected with a lattice-work 54 and cross-braces 56. As such, the three poles 46 can extend from the ground 32 upward and connect to the tower assembly 10.

It will be appreciated that a triangle arrangement is formed at the tip of a three poles tower (e.g., 8⅛ inch triangle, 10³⁄₁₆ inch triangle, etc.), which can dictate the arrangement of the support members 20. It will also be appreciated that the amount of poles 46 that form the antenna tower 38 may be three (as illustrated in FIG. 1) or any suitable number. With that said, the tower assembly 10 can have equal and corresponding amounts of support members 20 and coupling portions 48 or an unequal amount, e.g., four poles and three supports, eight poles and four supports, four poles and three supports, etc.

In one example and with reference to FIGS. 2 and 3, each of the vertical portions 40 of the support members 20 may define a longitudinal axis 58. In this regard, points 60 may be defined along each of the longitudinal axes 58 that, in turn, define a circle 61 about the mast member 12. Moreover, the point 62 may be defined along the longitudinal axis 30 that is defined by the mast member 12. The point 62 associated with the mast member 12 therefore may reside within the circle 61 defined by the points 60 associated with the support members 20. The mast member 12 may be centered in the circle 61 or can be offset from the center.

With reference to FIGS. 4A-6C, antenna mounting assemblies 34, 34*a* and 34*b* are shown in accordance with the present teachings. The antenna mounting assembly 34, 34*a*, 34*b* can include a collar 64, a spoke assembly 66 and a mounting or bracket assembly 68. With reference to FIGS. 4B, 4C, 5B and 5C, the spoke assembly 66 can include a pivot pin aperture 70 and a plurality of positioning pin apertures 72 formed in the spoke assembly 66. The mounting or bracket assembly 68 can include an antenna coupling 74 that can be configured to facilitate connection of the antenna array 36 or other suitable structures to the mounting or bracket assembly 68. Two bracket flanges 76 extend from the antenna coupling 74 toward the collar 64 with a portion of the spoke assembly 66 therebetween. A support plate 78 can connect each spoke assembly 66 to each other.

Figure 4A:
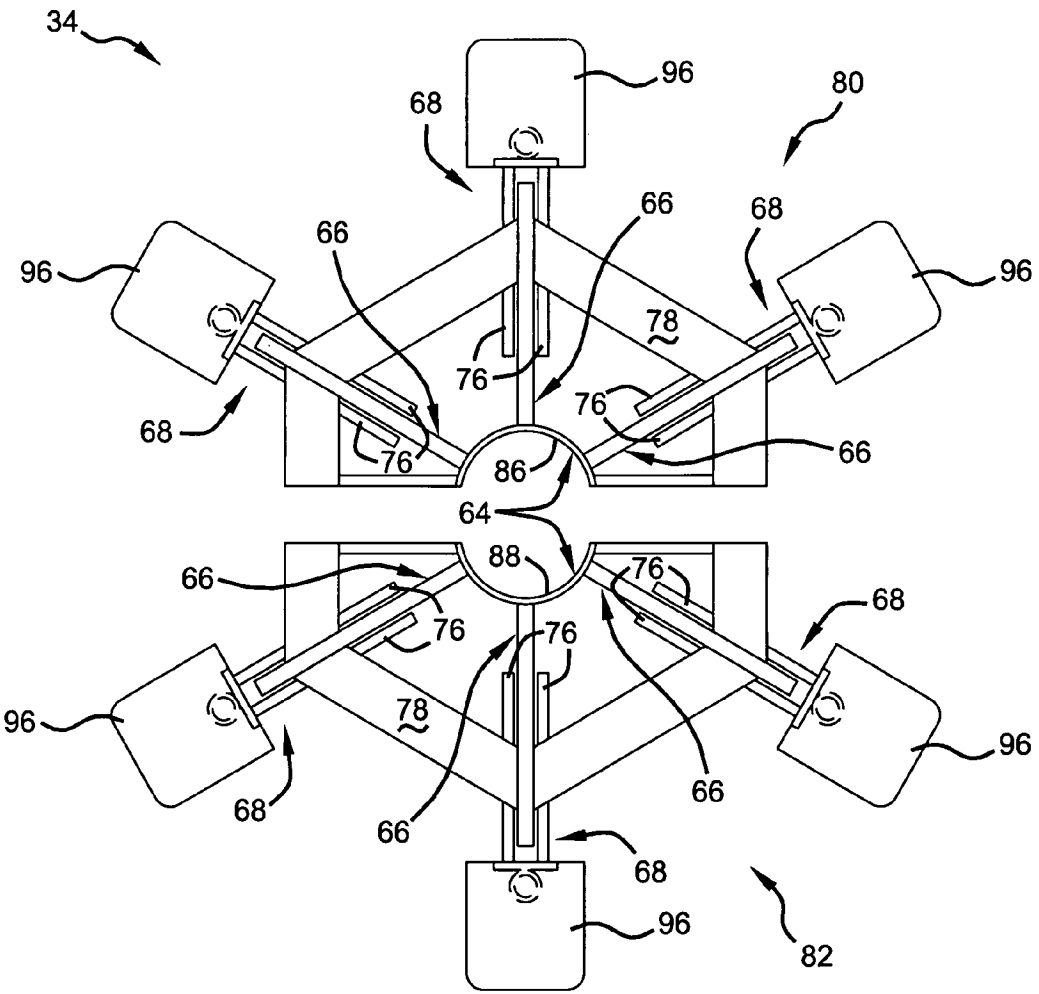
FIG. 4A is a top view of an antenna mounting assembly showing a collar, spoke assemblies and mounting or bracket assemblies in accordance with the present teachings.
Figure 5A:
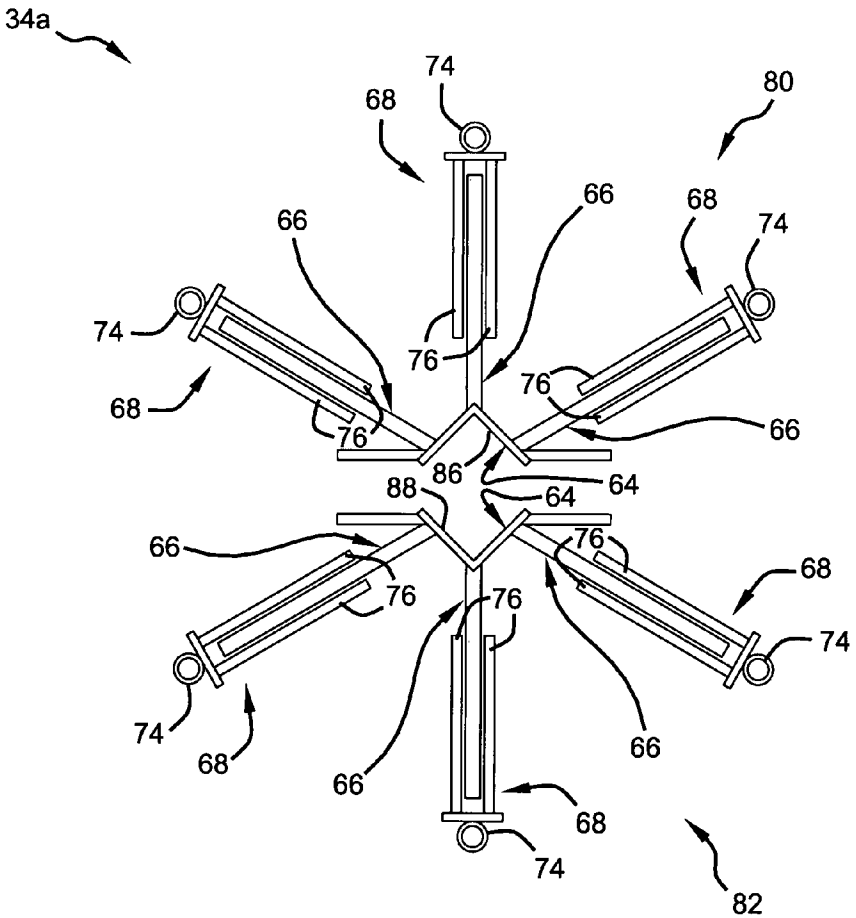
FIG. 5A is a top view of an alternative antenna mounting assembly showing a collar, spoke assemblies and mounting or bracket assemblies in accordance with the present teachings.
Figure 6A:
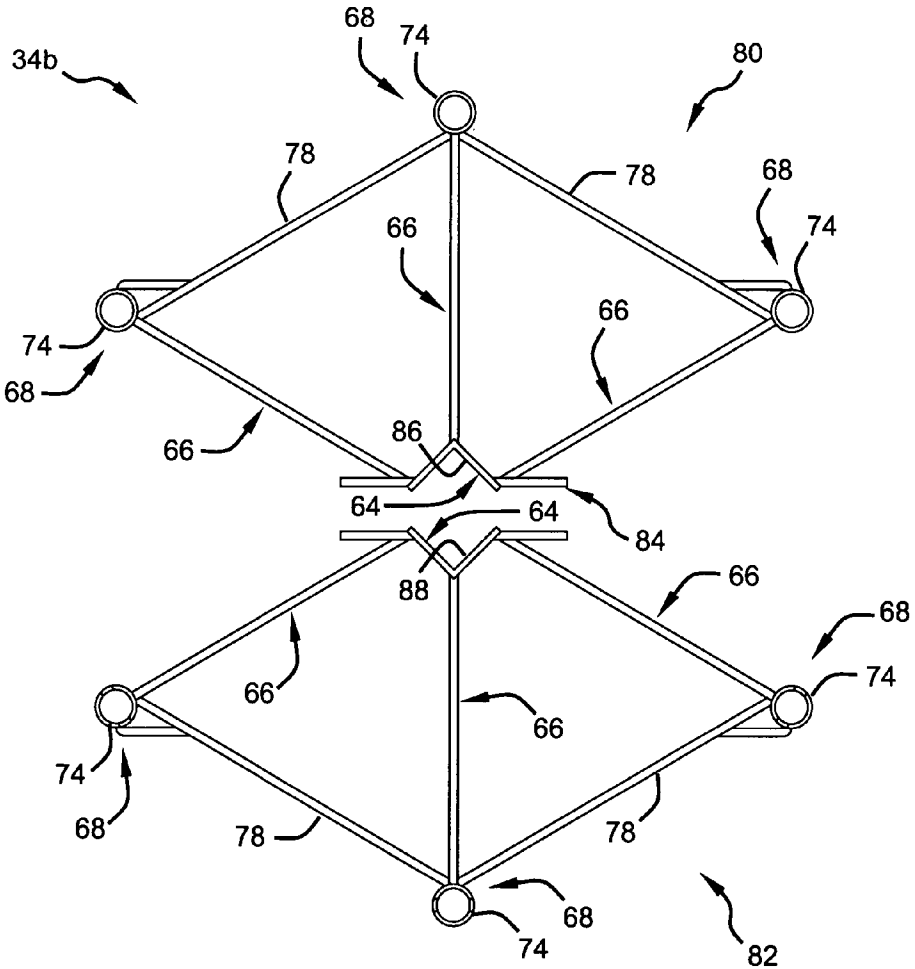
FIG. 6A is a top view of an alternative antenna mounting assembly showing a collar, spoke assemblies and mounting or bracket assemblies in accordance with the present teachings.
Figure 6B:
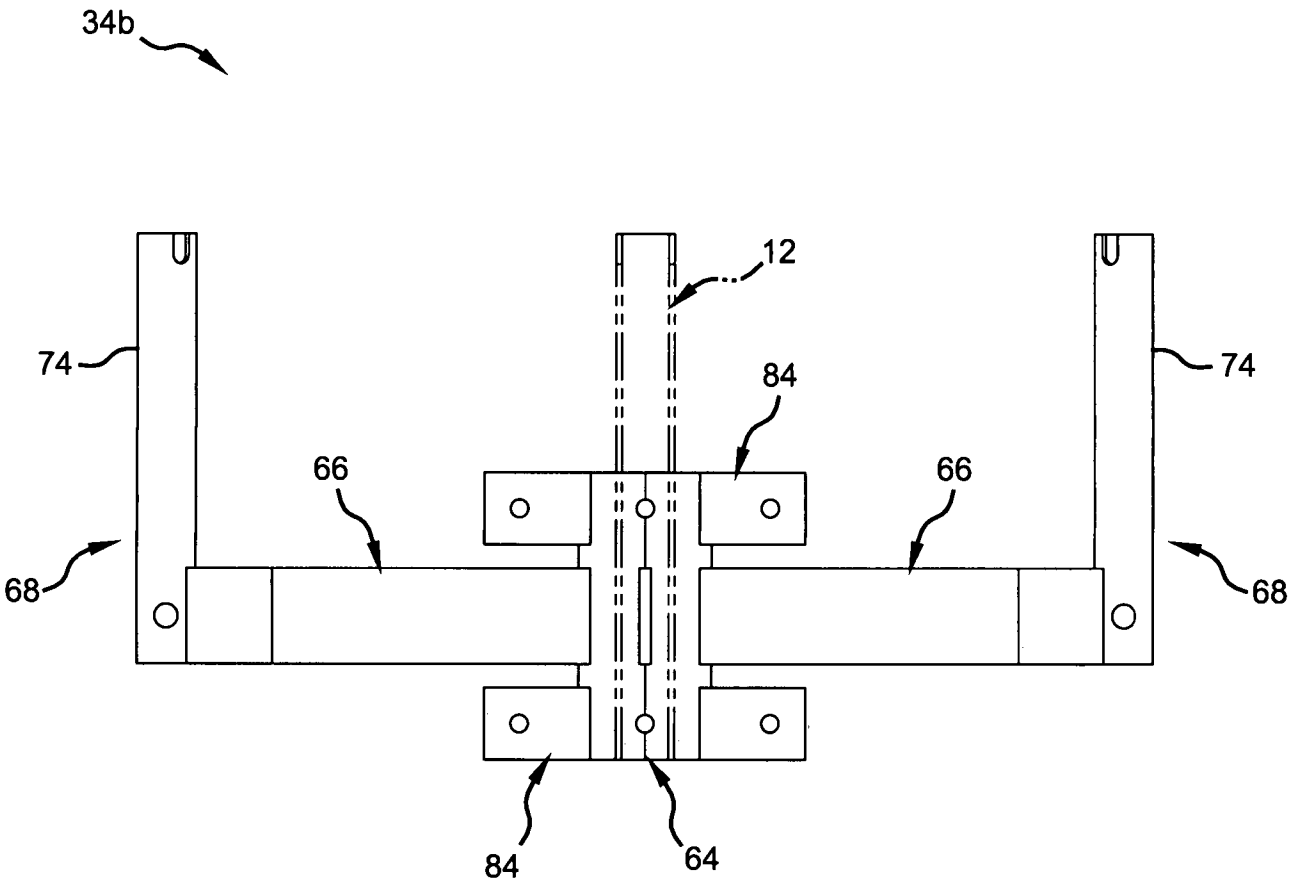
FIG. 6B is a side view of the antenna mounting assembly of FIG. 6A showing mounting or bracket assemblies extending from the respective spoke assemblies.

With reference to FIGS. 4A, 5A and 6A, the antenna mounting assembly 34, 34*a*, 34*b* includes a first section 80 and a second section 82. The first section 80 can be a mirror image of the second section 82. In other example, the second section 82 may omitted. To that end, the first section 80 includes three spoke assemblies 66 and three mounting or bracket assemblies 68 connected thereto. The collar 64 is, therefore, split in half (or a suitable fraction thereof) and can be re-assembled around the mast member 12 with suitable clamping devices to thus clamp the antenna mounting assembly 34, 34*a*, 34*b* to the tower assembly 10.

With reference to FIG. 4A, the support plate 78 can connect each spoke assembly 66 together and then connects to the collar 64. With reference to FIG. 6A, support plate 78 can connect each of the spoke assemblies 66 together but not further connect to the collar 64. Moreover, the support plate 78 need not be plate (as illustrated in FIG. 4A) but can various suitable shapes, e.g., a circular cross-section, as illustrated in FIG. 6A. In additional examples, the support plate 78 may contact the antenna couplings 74 at more than one location. More specifically, the support plate 78 adjacent to the antenna coupling 74 may bifurcate such that two pieces of the support plate 78 connect to the antenna coupling 74 at different locations. In other examples and with reference to FIG. 5A, support plate 78 may be omitted.

Figure 5B:
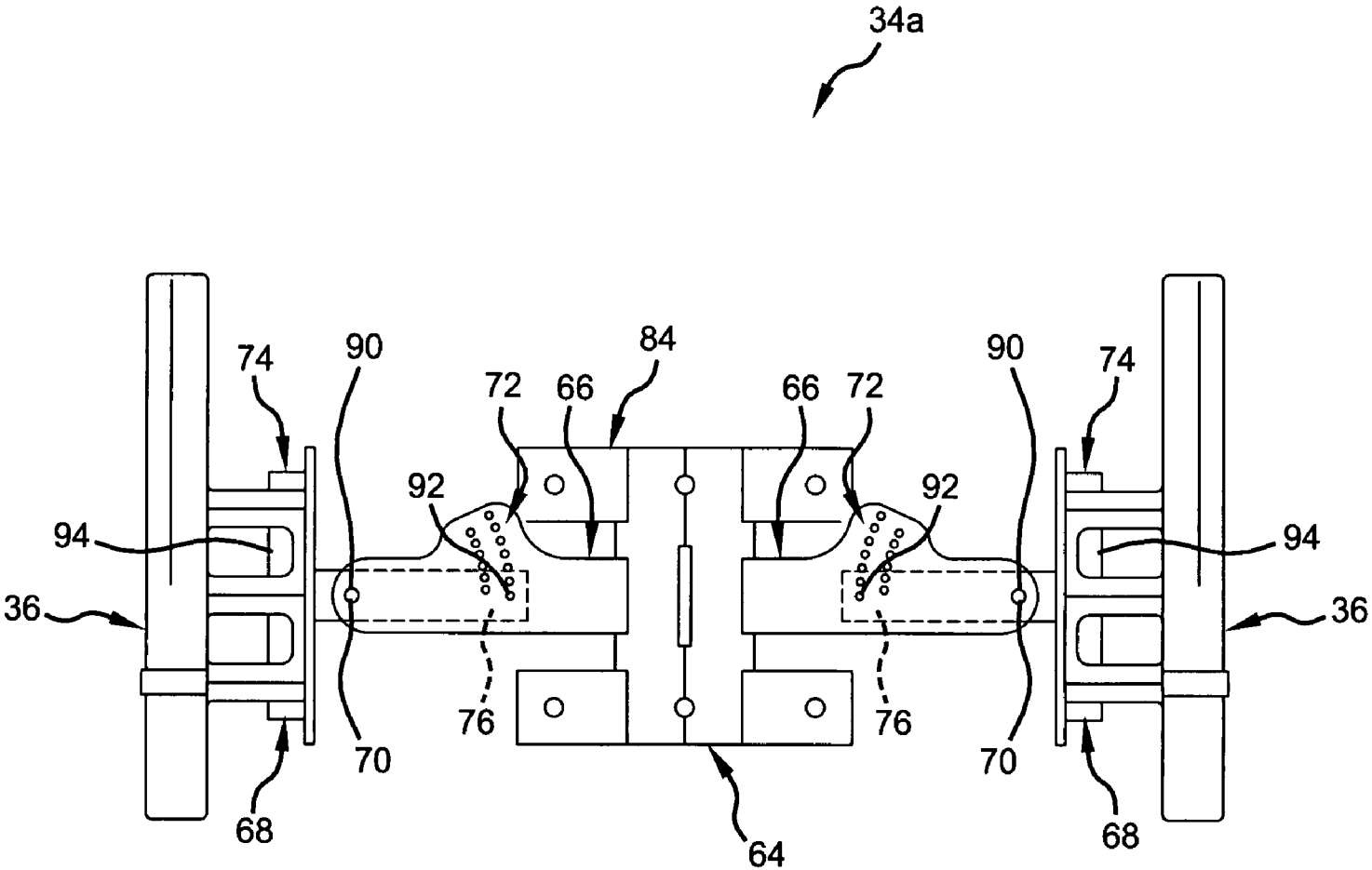
FIG. 5B is a side view of the antenna mounting assembly of FIG. 5A showing the mounting or bracket assemblies in a horizontal position relative to the respective spoke assemblies.
Figure 5C:
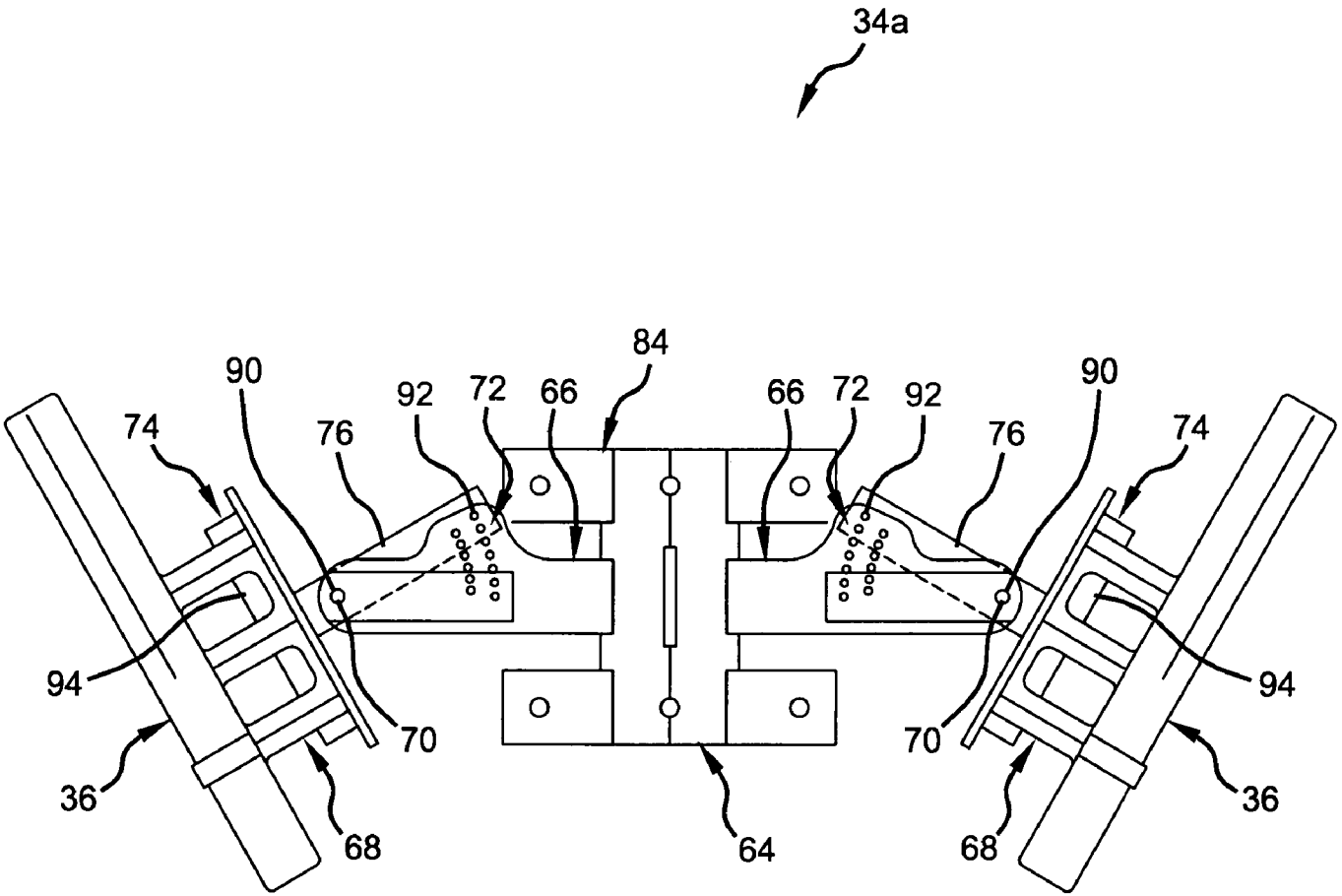
FIG. 5C is similar to FIG. 5B and shows the mounting or bracket assemblies tilted at an angle relative to the respective spoke assemblies.

With reference to FIGS. 5B and 5C, the collar 64 can include additional brackets, flanges, apertures 84 and/or other suitable components to facilitate clamping the first section 80 and the second section 82 to the mast member 12 (FIG. 2). With reference to FIG. 4A, a first portion 86 of the collar 64 associated with the first section 80 of the antenna mounting assembly 34 may have an arcuate section. Similarly, the second portion 88 of the collar 64 associated with the second section 82 may have a complimentary arcuate portion. The portions 86, 88 of the collar 64 may be joinable with each other and clamp against the mast member 12 to secure the antenna mounting assembly 34 thereto.

In one example, only the first section 80 of the mounting assembly 34, 34*a*, 34*b* can be installed. By way of the above example, the first portion 86 of the collar 64 is joined with a suitable bracket such that half of the mounting assembly 34, 34*a*, 34*b* is installed. The suitable bracket may be the second portion 88 of the collar 64 that is otherwise configured with no spoke assemblies 66. It will be appreciated that the mounting assembly 34, 34*a*, 34*b* can be coupled to the mast member 12 of the tower assembly, directly to a tower 10 and/or to other suitable structures, e.g., mono-poles (i.e., single pole towers).

With reference to FIG. 5A, the first portion 86 and the second portion 88 of the collar 64 may form complimentary rectangular shapes that may be joinable to thus clamp the antenna mounting assembly 34*a* to the mast member 12. With reference to FIG. 6A, the first portion 86 and the second portion 88 of the collar 64 of the mounting assembly 34*b* may have a similar configuration to the collar 64 of the antenna mounting assembly 34*a*, as illustrated in FIG. 5A. It will be appreciated that the various shapes formed by the portions 86, 88 of the collar 64 may be similar or dissimilar to the shape (i.e., cross-sectional shape) of the mast member 12. In this regard, the mast member 12 may have a circular cross-section while the collar 64 when joined together may have a rectangular cross-section or various suitable permutations thereof.

With reference to FIGS. 4B, 4C, 5B, 5C and 6B, two spoke assemblies 66 are illustrated with two mounting or bracket assemblies 68 connected thereto. The mounting or bracket assembly 68 includes the two bracket flanges 76. The two bracket flanges 76 pivot relative to the respective spoke assembly 66. More specifically, the two bracket flanges 76 pivot about a pivot pin 90 held in the pivot pin aperture 70. Each of the bracket flanges 76 may be positioned to a predetermined position and thus held in place by a position pin 92 that is held in one of the position pin apertures 72. The bracket flanges 76 may be weighted and/or configured as to balance the bracket or mounting assembly 68 to ease adjustment and/or positioning of the bracket or mounting assembly 68. In other examples, the bracket flanges 76 be weighted and/or configured as to balance the bracket or mounting assembly 68 and the antenna array 36 attached thereto to ease adjustment and/or positioning of the bracket or mounting assembly 68 and the antenna array 36.

In one example, portions of the mounting or bracket assembly 68 may be pivoted relative to the spoke assembly 66 and can be held at one of the pre-selected positions by inserting the position pin 92 through the associated position pin apertures 72. By selecting one of a plurality of positions, the mounting or bracket assembly 68 can pivot from a horizontal position (FIGS. 4B, 5B) (i.e., parallel with the ground 32) to a position where the mounting or bracket assembly 68 is tilted toward the ground 32 (FIGS. 4C, 5C). In various examples, the mounting assembly can tilt from the horizontal position (i.e., 0 degrees) to 30 degrees toward the ground. A larger or smaller range of motion can be provided by, for example, adding and/or moving the plurality position pin apertures 72.

The antenna mounting assembly 34, 34*a*, 34*b* can include six spoke assemblies 66. In this arrangement, six spoke assemblies 66 extend from the collar 64 in a generally orthogonal direction. The spoke assemblies 66 can be radially spaced from one another equally (i.e., every sixty degrees) or at unequal circumferential or peripheral spacing increments. Moreover, the support plate 78 can connect to each of the spoke assemblies 66 regardless of the above-mentioned circumferential or peripheral spacing.

The bracket or mounting assembly 68 and the antenna coupling 74 can be configured to connect to the exemplary antenna array 36 (or portions thereof). It can be appreciated that bracket or mounting assembly 68 and the antenna coupling 74 can be configured to connect the specific models of the antenna arrays 36 and antenna mounting assemblies 34. Moreover, each bracket or mounting assembly 68 and the antenna coupling 74 may connect to a single antenna array 36 may connect to multiple antenna arrays 36 and/or combinations thereof. In one example, a mounting pin 94 can be inserted between the antenna array 36 and the antenna coupling 74 to secure the antenna array 36 to the bracket or mounting assembly 68. Moreover, the mounting pin 94 can permit the antenna array 36 to be readily removed from the antenna mounting assembly 34, 34*a*, 34*b*.

Figure 4B:
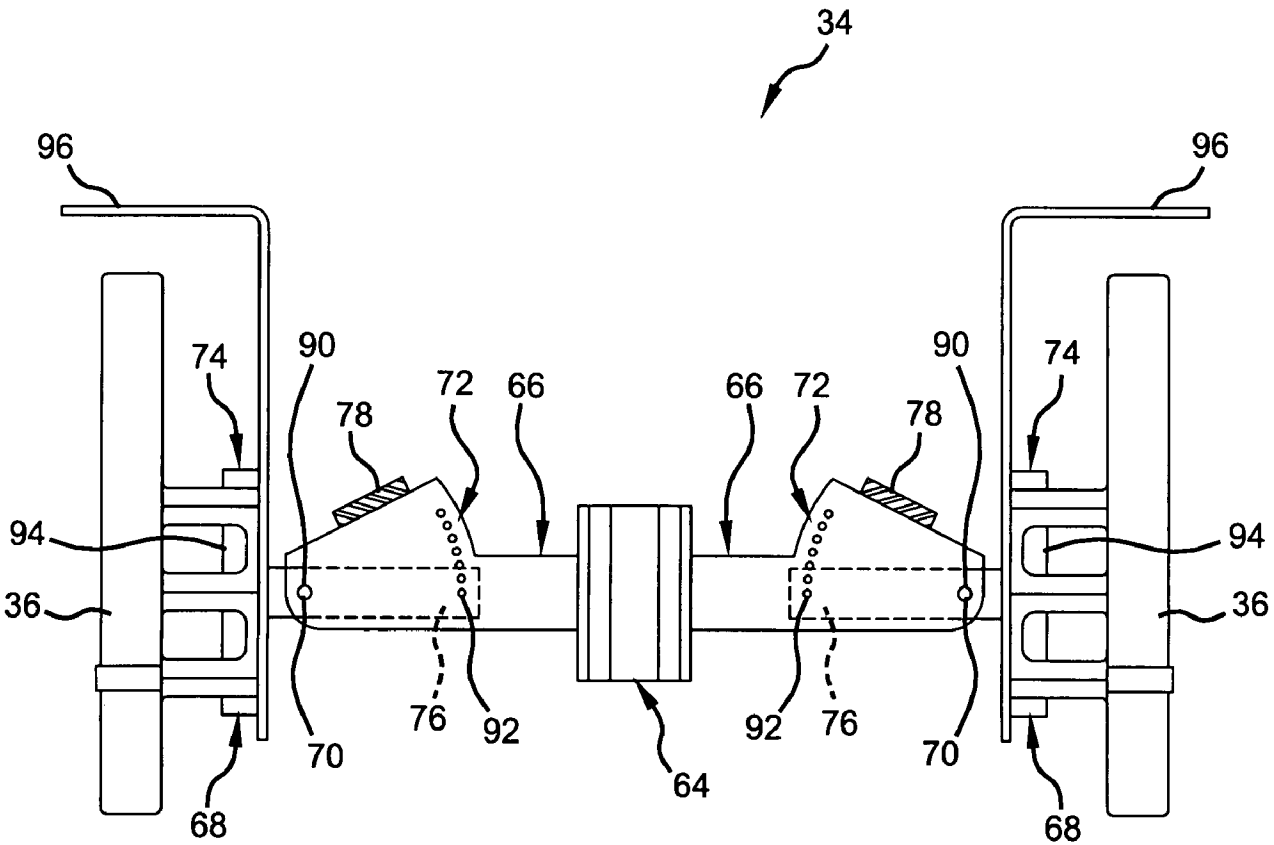
FIG. 4B is a side view of the antenna mounting assembly of FIG. 4A showing the mounting or bracket assemblies in a horizontal position relative to the respective spoke assemblies.
Figure 4C:
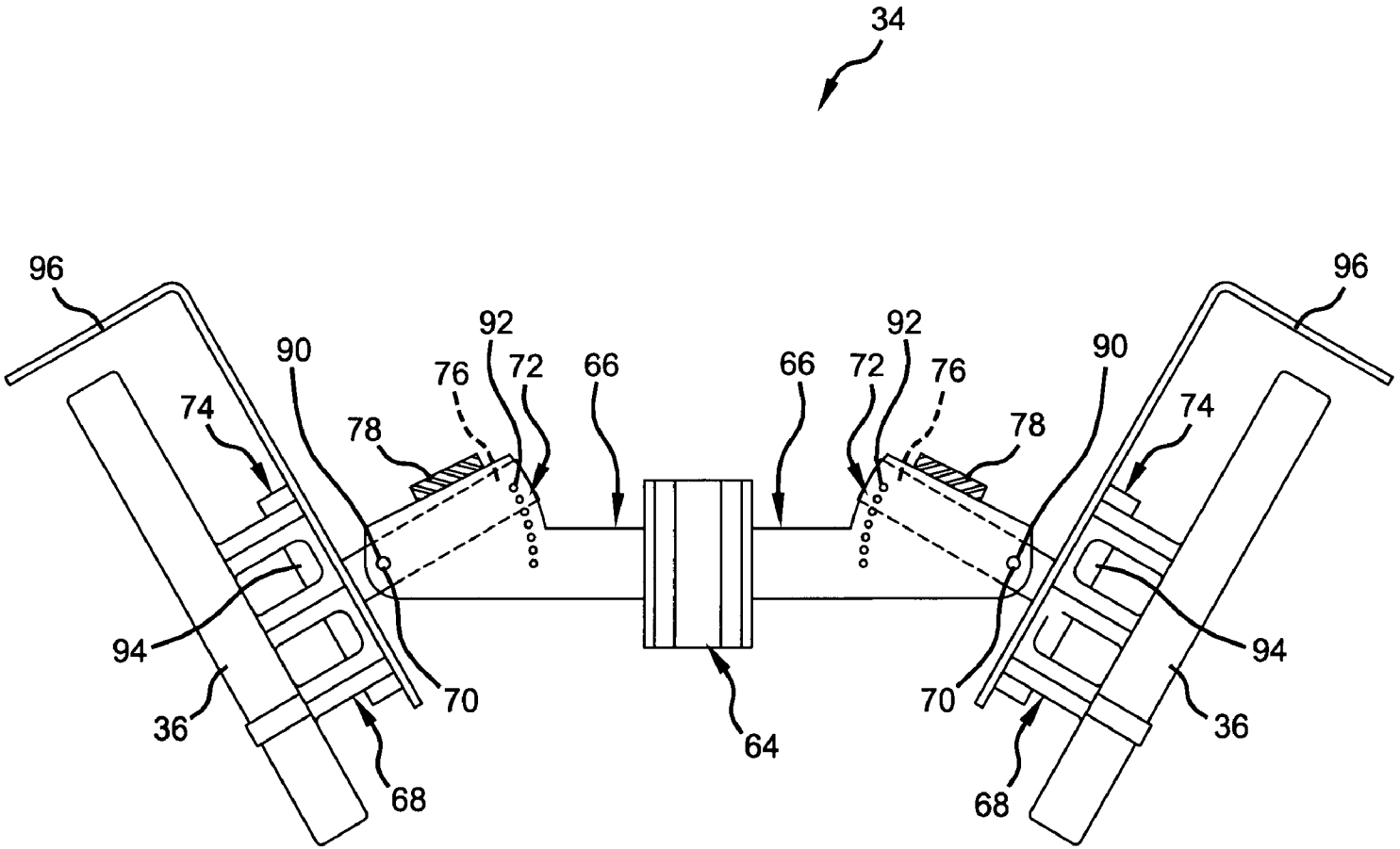
FIG. 4C is similar to FIG. 4B and shows the mounting or bracket assemblies tilted at an angle relative to the respective spoke assemblies.

In one example and with reference to FIGS. 4B and 4C, the antenna mounting assembly 34 can include a shield 96 that can be located on the spoke assembly 66 adjacent to the antenna coupling 74. The shield 96 can extend upwardly around the antenna array 36 and can be configured, for example, to focus electromagnetic radiation toward the antenna array 36. In one example, the shield 96 can be configured with a parabolic shape. It can be appreciated that the shape and size of shield 96 can be configured for a specific electromagnetic frequency. Moreover, the shield 96 can be configured to shield the antenna array 36 from the elements and keep wildlife off the antenna array 36.

The description of the various embodiments in accordance with the present teachings is merely exemplary in nature and, thus, variations that do not depart from the gist of the teachings are intended to be within the scope of the teachings. Such variations are not to be regarded as a departure from the spirit and scope of the teachings.

What is claimed is:

1. A mounting device comprising:

a first unitary subassembly having a first collar portion, a first spoke assembly extending from said first collar portion, and a first mounting assembly coupled to said first spoke assembly, said first collar portion is adapted to be coupled to an antenna tower; and a second unitary subassembly having a second collar portion, a second spoke assembly extending from said second collar portion, and a second mounting assembly coupled to said second spoke assembly, said second collar portion is adapted to be coupled to said antenna tower, wherein said first and second unitary subassemblies are adapted to be independently secured to said antenna tower.

2. The mounting device of claim 1 wherein each of said first and second spoke assemblies include multiple spoke assemblies.

3. The mounting device of claim 2, wherein said multiple spoke assemblies are spaced approximately an equal circumferential distance from each other.

4. The mounting device of claim 2 wherein each of said first and second spoke assemblies include three spoke assemblies.

5. The mounting device of claim 4 wherein said three spoke assemblies are spaced approximately an equal circumferential distance from each other.

6. The mounting device of claim 1 wherein at least a portion of said first mounting assembly pivots relative to said first spoke assembly.

7. The mounting device of claim 6 wherein at least said portion of said first mounting assembly pivots between at least two predetermined positions relative to said first spoke assembly and is releaseably secured in one of said plurality of predetermined positions.

8. The mounting device of claim 1 further comprising a mast member coupled to said first collar portion and said second collar portion.

9. The mounting device of claim 8 further comprising three support members, each of said support members having a vertical portion and an angled portion, said angled portion coupled to said mast member, said vertical portion operable to connect to said antenna tower and generally aligned with said mast member.

10. The mounting device of claim 9 wherein each of said support members connects to said mast member at a support connection, each of said support connections are circumferentially spaced from one another by about 120 degrees.

11. The mounting device of claim 9 further comprising a brace member that connects each of said support members to said mast member.

12. The mounting device of claim 9 wherein said mast member defines a point along a longitudinal axis defined by said mast member, each of said vertical members define points along respective longitudinal axes defined by said vertical members and wherein said point defined by said mast member is within a circle defined by said points defined by said respective vertical members.

13. The mounting device of claim 1, wherein said first mounting assembly is weighted to substantially pivotably balance said first mounting assembly about a pivot pin.

14. A mounting device comprising:

a tower assembly including a mast member and a plurality of support members that extend from said mast member, said support members capable of connecting to an antenna tower;

a first mounting assembly including a first collar portion that directly connects to said mast member, a first plurality of spokes extending from said first collar portion, and a first plurality of bracket assemblies pivotably engaging said first plurality of spokes and selectively securable at one of a plurality of predetermined angles relative to said first plurality of spokes; and a second mounting assembly including a second collar portion that directly connects to said mast member, a second plurality of spokes extending from said second collar portion, and a second plurality of bracket assemblies pivotably engaging said second plurality of spokes and selectively securable at one of said plurality of predetermined angles relative to said second plurality of spokes, wherein said first and second plurality of spokes are arranged to comprise a radial array of bracket assemblies and each of said array of bracket assemblies are spaced about sixty degrees apart from each other.

15. The device of claim 14, wherein each of said first and second plurality of bracket assemblies includes a bracket flange pivotably engaging a corresponding one of said first and second plurality of spokes about a pivot pin and selectively engaging one of a plurality of apertures to releasably secure said first and second bracket assemblies at one of said plurality of predetermined angles.

16. The device of claim 15, wherein said bracket flange is weighted to substantially pivotably balance a corresponding one of said first and second plurality of bracket assemblies about said pivot pin.

17. The device of claim 14, further comprising three support members, each of said support members having a vertical portion and an angled portion, said angled portion coupled to said mast member, said vertical portion adapted to connect to said antenna tower and generally aligned with said mast member.

18. The device of claim 14, wherein each of said support members connects to said mast member at a support connection, each of said support connections are circumferentially spaced from one another by about 120 degrees.

19. The device of claim 14, further comprising a brace member that connects each of said support members to said mast member.

20. The device of claim 14, wherein said support members include vertical members, and further wherein said mast member defines a point along a longitudinal axis defined by said mast member, each of said vertical members define points along respective longitudinal axes defined by said vertical members and wherein said point defined by said mast member is within a circle defined by said points defined by said respective vertical members.

* * * * *

UNITED STATES PATENT AND TRADEMARK OFFICE

CERTIFICATE OF CORRECTION

PATENT NO. : 7,576,705 B2
APPLICATION NO. : 11/267639
DATED : August 18, 2009
INVENTOR(S) : Greenfield et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 553 days.

Signed and Sealed this

Seventh Day of September, 2010

David J. Kappos

David J. Kappos
*Director of the United States Patent and Trademark Office*